US009300021B2

(12) United States Patent
Yang et al.

(10) Patent No.: US 9,300,021 B2
(45) Date of Patent: Mar. 29, 2016

(54) MILLIMETRE WAVE BANDPASS FILTER ON CMOS

(75) Inventors: Bo Yang, Thornbury (AU); Stan Skafidas, Thornbury (AU); Robin Evans, Aspendale (AU)

(73) Assignee: NITERO PTY LIMITED, Fitzroy (AU)

( * ) Notice: Subject to any disclaimer, the term of this patent is extended or adjusted under 35 U.S.C. 154(b) by 838 days.

(21) Appl. No.: 13/120,214

(22) PCT Filed: Sep. 23, 2008

(86) PCT No.: PCT/AU2008/001410

§ 371 (c)(1),
(2), (4) Date: Jun. 15, 2011

(87) PCT Pub. No.: WO2010/034049

PCT Pub. Date: Apr. 1, 2010

(65) Prior Publication Data

US 2011/0248799 A1 Oct. 13, 2011

(51) Int. Cl.
*H01P 1/203* (2006.01)
*H01P 7/08* (2006.01)

(52) U.S. Cl.
CPC ..... *H01P 1/20372* (2013.01); *H01P 1/20336* (2013.01); *H01P 7/08* (2013.01); *Y10T 29/49117* (2015.01)

(58) Field of Classification Search
USPC ..... 333/219, 235, 204, 205, 185
See application file for complete search history.

(56) References Cited

U.S. PATENT DOCUMENTS

| | | | | |
|---|---|---|---|---|
| 4,853,660 | A | 8/1989 | Schloemann | |
| 5,187,460 | A | 2/1993 | Forterre et al. | |
| 5,616,538 | A * | 4/1997 | Hey-Shipton et al. | 505/210 |
| 8,576,026 | B2 * | 11/2013 | Liu et al. | 333/204 |
| 2003/0011440 | A1 | 1/2003 | Aiga et al. | |
| 2004/0233022 | A1 * | 11/2004 | Tsuzuki et al. | 333/204 |
| 2005/0088258 | A1 | 4/2005 | Fischer | |
| 2005/0090300 | A1 | 4/2005 | Zhang et al. | |
| 2006/0154638 | A1 | 7/2006 | Zheng et al. | |
| 2007/0069838 | A1 * | 3/2007 | Kayano et al. | 333/204 |
| 2011/0279199 | A1 * | 11/2011 | Soora | 333/204 |

FOREIGN PATENT DOCUMENTS

| | | | | |
|---|---|---|---|---|
| SE | WO 2005/064737 | * | 7/2005 | H01P 1/203 |
| WO | WO 99/18629 | | 4/1999 | |

OTHER PUBLICATIONS

Rodrigo Neves Martin et al., "Techniques Yield Tiny Hairpin-Line Resonator Filters", Microwave & RF, Nov. 1999, 10 pgs.
C.M. Ta et al., "Issues in the Implementation of 60GHz Transceiver on CMOS", IEEE International Workshop on Radio-Frequency Integration Technology, Dec. 9-11, 2007, pp. 135-140.

(Continued)

*Primary Examiner* — Robert Pascal
*Assistant Examiner* — Gerald Stevens
(74) *Attorney, Agent, or Firm* — Hickman Palermo Becker Binham LLP

(57) ABSTRACT

Q of resonant elements formed over lossy substrates such as in a CMOS process is improved by forming the ground plane of the resonant element immediately over a high impedance layer to reduce cross coupling and eddy currents. A new type of meandering hairpin resonator configuration is also introduced providing, for example, for 4th order cross coupled filters of high selectivity and compact layout.

15 Claims, 11 Drawing Sheets

(56) References Cited

OTHER PUBLICATIONS

Cheng-Ying Hsu et al., "Design of 60-GHz Millimeter-Wave CMOS RFIC-on-Chip Bandpass Filter", Proceedings of the 37$^{th}$ European Microwave Conference, Oct. 2007, pp. 672-675.
Bo Yang et al., "Design of 60GHz Millimetre-Wave Integrated SIR-MH Microstrip Bandpass Filters on Bulk CMOS", Proceedings of the 38$^{th}$ European Microwave Conference, Oct. 2008, pp. 841-844.
Chun-Lin Ko et al., "On-Chip Transmission Line Modeling and Applications to Millimeter-Wave Circuit Design in 0.13um CMOS Technology", IEEE, 2007, 4 pgs.
Bo Yang et al., "Design of Integrated Millimetre-Wave Integrated Microstrip Interdigital Bandpass Filters on CMOS Technology", Proceedings of the 37$^{th}$ European Microwave Conference, Oct. 2007, pp. 680-683.
S. Sun et al., "40GHz Compact TFMS Meander-Line Bandpass Filter on Silicon Substrate", Electronics Letters, vol. 43 No. 25, Dec. 6, 2007, 2 pgs.
Sheng Sun et al. "Millimeter-Wave Bandpass Filters by Standard 0.18-μm CMOS Technology", IEEE Electron Device Letters, vol. 28, No. 3, Mar. 2007, pp. 200-222.
Sheng-Yuan Lee et al., "A New Network Model for Miniaturized Hairpin Resonators and Its Applications", IEEE MTT-S Digest, 2000, pp. 1161-1164.
B. Yang et al., "Implementation of a Gigabit Per Second Millimetre Wave Transceiver on CMOS", IEEE 2$^{nd}$ International Conference on Wireless Broadband and Ultra Wideband Communications, AusWireless, 2007, 4 pages.
J.S. Hong et al., "Couplings of Microstrip Square Open-Loop Resonators for Cross-Coupled Planar Microwave Filters", IEEE Transactions on Microwave Theory and Techniques, vol. 44, No. 12, Dec. 1996, 11 pages.
S. Darlington, "Synthesis of Reactance 4-Poles which Produce Prescribed Insertion Loss Characteristics", Journal of Mathematics and Physics, Sep. 1939, vol. 18, pp. 257-353.
PCT International Search Report and Written Opinion, Application No. PCT/AU2008/001410, Australian Patent Office, Dec. 2008, 9 pages.
IP Australia, "Examination Report No. 1", in application No. 2008362015, dated May 16, 2014, 3 pages.
Current Australian Claims in application No. 2008362015, dated May 16, 2014, 2 pages.
The Mosis Service: Vendors: IMB: 8RF-DM, www.mosis.com/vendors/view/ibm/8rf-dm, dated Jul. 17, 2014, 2 pages.

* cited by examiner

MILLIMETRE WAVE BANDPASS FILTER ON CMOS

TECHNICAL FIELD

The present invention relates to fabrication of monolithic resonant components on conductive substrates, and in particular relates to improving the Q of resonant components by providing a layer or layers of high impedance shielding over the substrate and beneath the resonant components. The present invention also provides a new compact meandering hairpin resonator design suitable particularly for filter construction.

BACKGROUND OF THE INVENTION

There exists a large allocated bandwidth around the 60 GHz region of the electromagnetic spectrum, offering the appeal of high-speed short distance wireless personal area networks (WPANs), radar applications such as automotive radar, along with other potential industrial, scientific and medical applications. This has raised interest in low cost, high efficiency and small form factor integrated millimeter-wave devices in order to facilitate their use in consumer electronic applications. Wireless systems operating at such millimeter-wave frequencies require appropriate antennas and RF components.

Bandpass RF filters are critical for modern wireless communication systems. The filter ensures that the communication system does not transmit power in frequencies that are used by other users or prohibited by regulatory authorities. In order to achieve increasingly higher data rates modern high speed wireless communication systems use complex modulation schemes such as orthogonal frequency division multiplexing (OFDM). Out of band emissions are particularly problematic for OFDM systems where the high peak to average ratio occasionally pushes the transmit power amplifier into compression that generates, if unfiltered, outputs harmonics of the input signal and consequently high out-of-band spectral content. At lower frequencies, system designers and RF engineers include external bandpass filters to ensure the transmit power spectral density mask meets regulatory requirements. Unfortunately external bandpass filters are expensive and the transition from chip to the printed circuit board mounted filter usually degrades the signal.

As communication systems move to millimeter wave frequencies the physical dimensions of RF components becomes smaller than the usual size of a CMOS die, making it theoretically possible to have most of the wireless transceiver implemented on a single CMOS die, which motivates the development of system on chip or system in a package. CMOS is a standard and low cost process for building digital circuits, but CMOS active filters are unidirectional, suffer from distortion at high power and increase noise figure. To date, designs have mostly avoided fabricating passive on-chip filters on standard CMOS technology, because of the lossy conductive nature of the silicon substrate, poor performance, low quality factor (Q) of the resonators in filters, unstable performance due to relatively large fabrication variation, and stringent foundry fabrication design rules. Most integrated passive filters are thus built on high-resistivity substrate materials, however these raise costs.

Any discussion of documents, acts, materials, devices, articles or the like which has been included in the present specification is solely for the purpose of providing a context for the present invention. It is not to be taken as an admission that any or all of these matters form part of the prior art base or were common general knowledge in the field relevant to the present invention as it existed before the priority date of each claim of this application.

Throughout this specification the word "comprise", or variations such as "comprises" or "comprising", will be understood to imply the inclusion of a stated element, integer or step, or group of elements, integers or steps, but not the exclusion of any other element, integer or step, or group of elements, integers or steps.

SUMMARY OF THE INVENTION

According to a first aspect the present invention provides a method of fabricating a monolithic millimeter wave resonant device upon a conductive substrate, the method comprising:

forming upon the substrate high impedance elements; and forming resonant elements of the resonant device over the high impedance elements.

According to a second aspect the present invention provides a monolithic millimeter wave resonant device, comprising:

a conductive substrate;

high impedance elements formed upon the substrate; and resonant elements formed over the high impedance elements.

The conductive substrate for example may be silicon based, and the monolithic fabrication process may be CMOS based. Each high impedance element preferably comprises alternating layers of metal and a dielectric such as silicon dioxide.

According to a third aspect the present invention provides a meandering hairpin resonator for a monolithic millimeter wave resonant device, the resonator formed of a longitudinal conducting strip comprising:

a substantially straight primary strip portion two secondary strip portions extending from respective ends of the primary strip portion and at substantially 90 degrees to the primary strip portion, each secondary strip portion comprising a resonating portion for resonating with a proximal resonator, the two resonating portions being spaced apart by a distance less than a length of the primary strip portion.

According to a fourth aspect the present invention provides a method of fabricating a meandering hairpin resonator formed of a longitudinal conducting strip, the method comprising:

forming a substantially straight primary strip portion; and forming two secondary strip portions extending from respective ends of the primary strip portion and at substantially 90 degrees to the primary strip portion, each secondary strip portion comprising a resonating portion for resonating with a proximal resonator, the two resonating portions being spaced apart by a distance less than a length of the primary strip portion.

Preferably corners formed by the conducting strip are mitered and chamfered to minimise losses.

A 4th order cross coupled filter comprising two meandering hairpin resonators in accordance with the third aspect of the invention and further comprising two step impedance miniature hairpin resonators.

BRIEF DESCRIPTION OF THE DRAWINGS

An example of the invention will now be described with reference to the accompanying drawings, in which.

DESCRIPTION OF THE PREFERRED EMBODIMENTS

The present invention recognises that designing high quality filters on CMOS is particularly challenging because of the conductive silicon substrate. Unlike other substrates which are isolating, the conductive silicon bulk reduces the quality factor of the resonators, and introduces non linear effects and distortion due to both induced eddy currents in the substrate as well as the coupling of signals through the substrate between non adjacent resonators.

Figure 1:
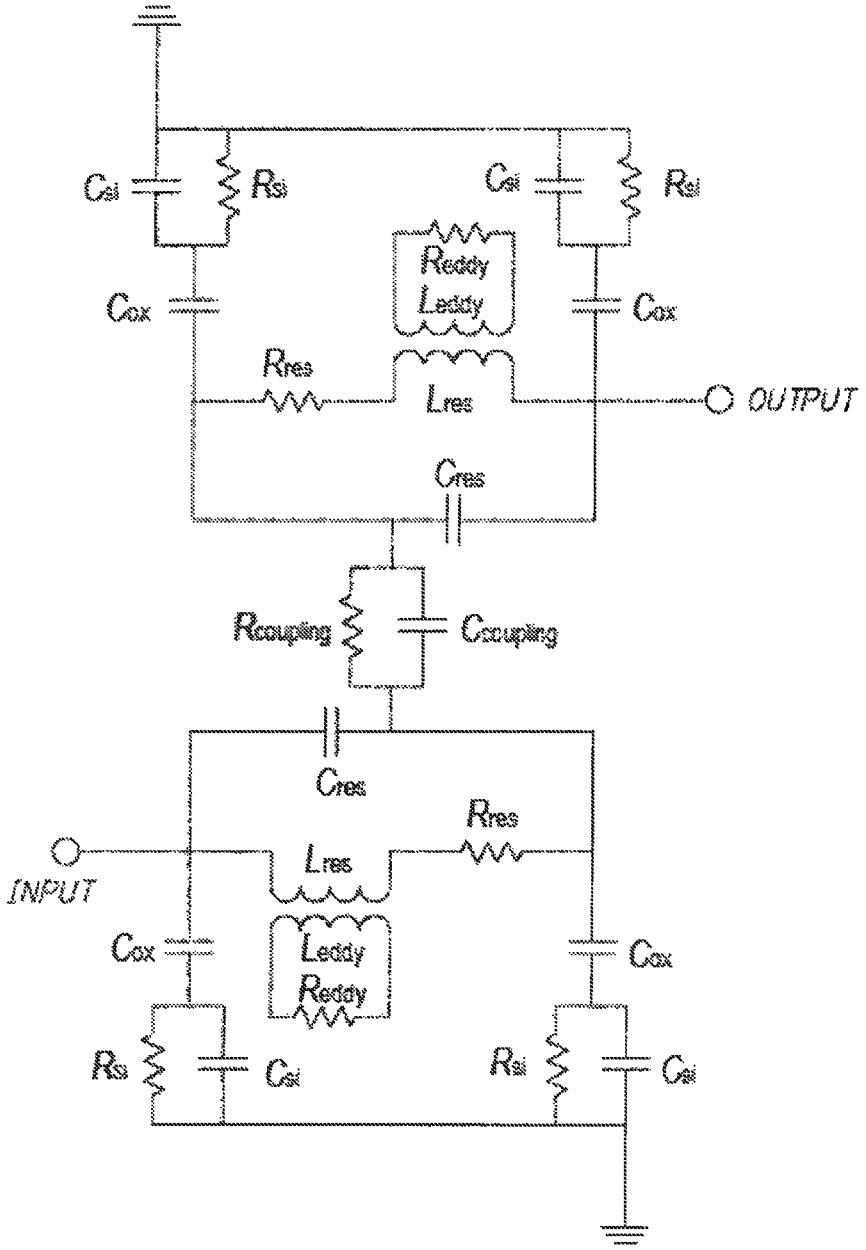
FIG. 1 is a circuit schematic of the primary coupling components between adjacent resonators.

FIG. 1 illustrates the major coupling components between adjacent resonators. In this figure $C_{ox}$, $C_{si}$ and $R_{si}$ are the capacitance of the oxide, the capacitance of the silicon and the resistance of the silicon, respectively. $C_{res}$ and $L_{res}$ are the effective capacitance and inductance of the resonators. $R_{res}$ accounts for the metal conductive loss in strips due to metal's intrinsic resistive characteristics and the skin effect that cannot be neglected under high frequencies. $C_{coupling}$ denotes proximity coupling that one tries to control to design the desired transfer function of the interdigital filter. Note that $R_{coupling}$ and $R_{eddy}$ are the extra loss of couplings between resonators that are presented on CMOS substrates due to the low resistivity substrate and the eddy currents that are induced in the substrate.

In order to minimize the coupling between non-adjacent resonators and to reduce induced eddy currents, the substrate was segmented into regions of high impedance directly under each resonator. This is accomplished by implementing a high impedance ground (BFMOAT) between resonators. A high impedance bounding box is also built around the whole structure. This method reduces the coupling through the substrate.

The following steps were taken to build an integrated interdigital filter operating at millimeter wave frequencies on CMOS.

Step 1. An ideal filter prototype with certain number of orders is determined. From ideal values of the prototype circuit, the coupling coefficient matrix and the required external quality factor of the filter are calculated.

Step 2. The substrate eddy current and coupling suppression structures are designed. With the aid of a 3D Full-Wave EM simulator the implemented structures to minimize loss due to substrate coupling between resonators as well as coupling between the resonator and the substrate are simulated. In this example the conductive substrate was segmented using high impedance regions as set out in the preceding.

Step 3. An appropriate CMOS metal layer for the resonators is chosen noting that metal layer thickness and spacing are fixed by the process technology. 3D Full-Wave Simulator was used to ensure minimum loss for the designed single resonator.

Step 4. The approximate dimensions (width, length) of a single resonator to meet the performance of Step 1 are determined.

Step 5. The spacing between adjacent resonators, and the positions of the feeds of the input/output lines are estimated using appropriate formulae. These design parameters were refined using a 3D Full-Wave EM simulator to determine spacing between adjacent resonators, and the positions of the feeds of the input/output lines that produce best performance.

Step 6. 3D Full-Wave simulations for the complete design were compared to specifications. If the specifications meet the design requirements the design is complete. If not return to Step 3 and iterate.

Figure 2:
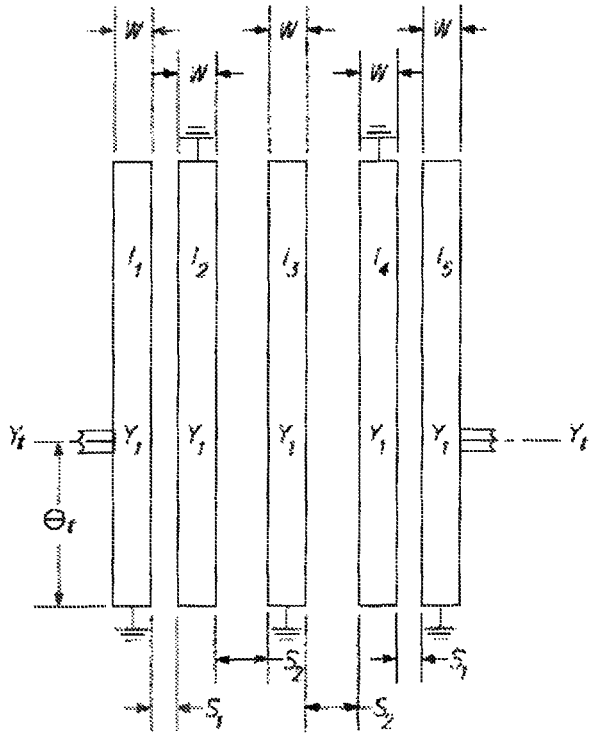
FIG. 2 illustrates the layout of a microstrip band pass filter formed over high impedance elements in accordance with a first embodiment of the first and second aspects of the invention.

A filter design example is now discussed. A 5-order symmetric interdigital bandpass filter with tapped-line input/output (IO), as indicated in FIG. 2, was designed with a passband of 2 GHz and a mid-band frequency of 55 GHz. As shown in FIG. 2, the resonators all have the same width W and characteristic impedance denoted by $Y_1$. The resonators have varying line lengths denoted by $l_1$, $l_2$ . . . $l_5$. The coupling between resonators is due to the fringe fields in adjacent resonators and can be varied by changing the spacing between resonators. Due to the symmetric structure of this system only spacings $s_1$ and $s_2$ need to be considered.

Input/Output (I/O) to the filter is achieved by combining a tapped-line with a characteristic impedance $Y_t$, which is identical to source/load characteristic impedance $Y_0$ of 50 A. The electrical length $\theta_t$ indicates the tapping position of I/O and is measured from the short-circuited end of the I/O resonator.

Using appropriate design equations and procedures for the design of interdigital bandpass filters with coupled-line I/O and with tapped-line I/O, the circuit design parameters are evaluated and are listed in Table I.

TABLE I

Circuits design parameters of the 5-pole, interdigital bandpass filter with symmetric coupled lines

| i | $Z_{0ei,i+1}$ | $Z_{0oi,i+1}$ | $k_{i,i+1}$ |
|---|---|---|---|
| 1 | 51.1386 | 48.8614 | 0.0228 |
| 2 | 50.8566 | 49.1217 | 0.0174 |
| 3 | 50.8566 | 49.1217 | 0.0174 |
| 4 | 51.1386 | 48.8614 | 0.0228 |

$Y_1$ = 1/49.974 mhos
$Y_t$ = 1/50 mhos
$\theta_t$ = 0.1614 radians
$C_t$ = 0.2313 fF As a consequence of the fact that the widths of line resonators for symmetric interdigital filters are the same it is in most practical cases extremely difficult to obtain the desired $Z_{0ei,i+1}$ and $Z_{0oi,i+1}$ by adjusting the spacing $s_i$ (i=1 or 2) alone.

A high impedance substrate is created using the techniques described in the preceding. In the design process instead of matching to the desired $Z_{0ei,i+1}$ and $Z_{0oi,i+1}$, the spacing $s_i$ (i=1 or 2) are adjusted to match the coupling coefficient $k_{i,i+1}$ which can be extracted by using the following relation:

$$k_{i,i+1} = \frac{Z_{0ei,i+1} - Z_{0oi,i+1}}{Z_{0ei,i+1} + Z_{0oi,i+1}} \quad (1)$$

In the present design a full-wave three-dimensional (3D) electromagnetic (EM) simulator (Ansoft-HFSS) was used to determine the physical dimensions. The width W for line resonators with the characteristic impedance of $Y_1$, and $W_t$ for the tapped-line with the single characteristic impedance of $Y_t$ were determined by simulating a single resonator.

By simulating two coupled-lines, the spacing $s_i$ (i=1 or 2) was determined to achieve the desired coupling coefficient $k_{i,i+1}$ as well as corresponding even- and odd-mode relative dielectric constants $\in_{rei}^{e}$ and $\in_{rei}^{o}$.

Initial estimates for the physical lengths $l_i$ of line resonators and the physical distance $l_t$ measured from tapped point to the I/O resonator short-circuited end were evaluated by using appropriate equations. These estimates were refined using the full wave 3D EM simulator. The physical dimensions of the filter are listed in Table II.

TABLE II

Physical Dimensions Of The 5-Pole, Interdigital Bandpass Filter With Symmetric Coupled Lines

| Dimensions (um) | | | |
|---|---|---|---|
| $W_1$ | 23.00 | $l_1$, $l_5$ | 588.05 |
| $W_t$ | 21.78 | $l_2$, $l_3$, $l_4$ | 576.05 |
| $s_1$ | 32.40 | $l_t$ | 125.00 |
| $s_2$ | 37.70 | | |

In order to mitigate the performance degradation due to the discontinuity of the tee-junction formed when the tapped-line connects to the I/O line resonator, a 45-degree miter is applied for compensation.

The design was fabricated on the IBM 0.13 um standard CMOS. The stack-up comprises of a 737 um bulk silicon ($M_r$=11.9) substrate. Immediately above the silicon substrate and below the first metal layer, there is 0.5 um thick nitride ($M_r$=7.0) layer. In this fabrication technology there are a total of eight metal layers: three thin copper layers closest to the substrate, two thick copper layers, and three RF layers (one copper layer and two aluminium layers). Between the metal layers is silicon dioxide ($M_r$=4.1 or 3.6 depending on metal/via interlevel dielectric). On top of the final RF metal layer there is the "Final Passivation" layer comprising a 1.35 um thick silicon oxide followed by a 0.45 um thick nitride and a 2.5 um thick polyimide.

Figure 3:
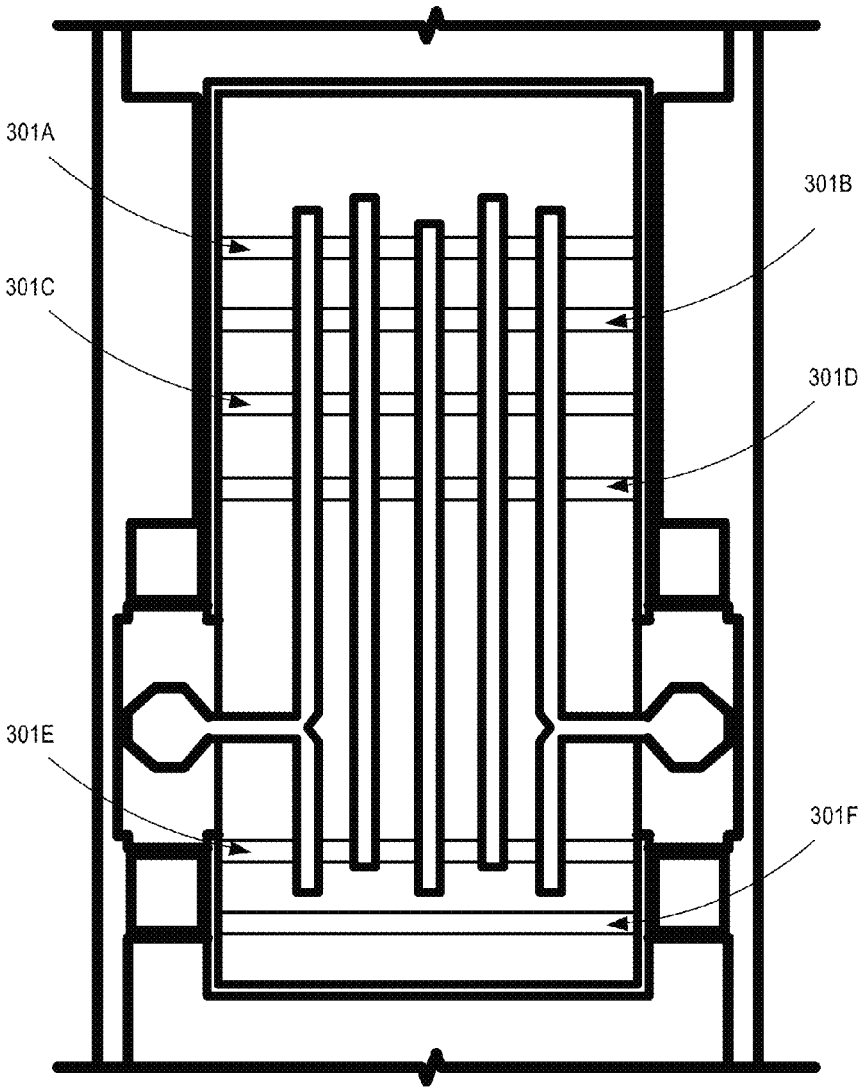
FIG. 3 is a schematic diagram of the fabricated filter of FIG. 2.
Figure 14:
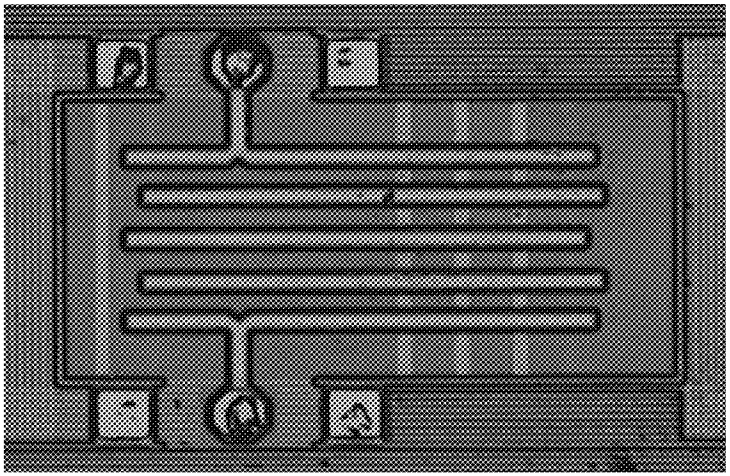
FIG. 14 is a microphotograph of the fabricated filter of FIG. 2.

The design presented in this paper was built on the top RF aluminum metal layer with the ground plane fabricated on metal layer 1 the bottom thin copper metal layer. FIG. 14 shows a photograph of the fabricated filter. FIG. 3 shows a schematic of the fabricated filter. From FIG. 3, it can be noticed that several lateral metal lines 301 cross beneath the line resonators. These were built on other RF metal layers in order to meet foundry minimum density metal fill rules for the integration with active circuits on a standard CMOS process.

Figure 4:
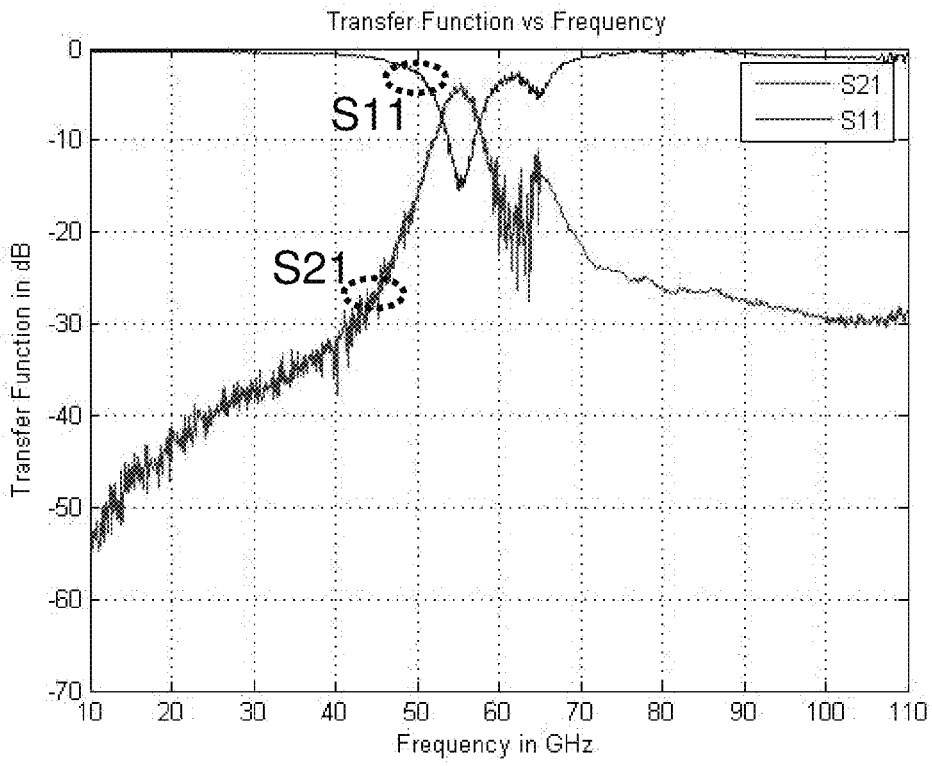
FIG. 4 is a plot of the transfer function of the filter of FIG. 3.

A Suss-Microtech Probe Station with 110 GHz probes and a 110 GHz Anritsu Vector Network Analyser were used to measure the filter shown in FIG. 3. The measured results of $S_{11}$ and $S_{21}$ are shown in FIG. 4. From FIG. 4, it can be seen that the fabricated filter has a midband frequency of 55.3 GHz with a fractional bandwidth of 3.25% (from 54.4 to 56.2 GHz). The insertion loss over passband is around −4.5 dB, while its return loss is better than −13 dB over pass band.

The lossy nature of the CMOS substrate and the lateral lines added for minimum density metal fills in the CMOS fabrication process have caused a higher insertion loss. The small decrease in bandwidth (from 2 to 1.8 GHz) and the small shift of the mid-band frequency (from 55 to 55.3 GHz) are attributed to process and fabrication variations. This design and fabrication thus illustrates the feasibility of building an on-chip filter for the RF front-end of the wireless system.

Figure 12:
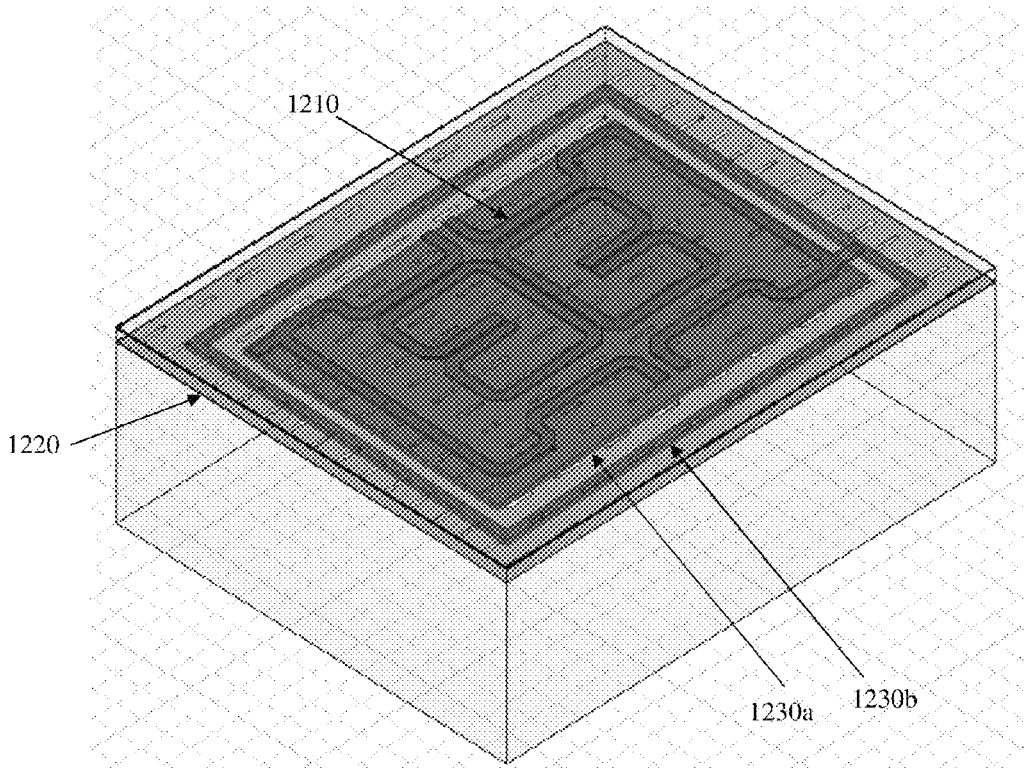
FIG. 12 is a perspective view of the fabricated die.

Notably, the high impedance layer (e.g., high impedance shielding layer 1230 of FIG. 12) is not treated as the normal ground plane but is placed immediately under the metal ground plane (e.g., ground plane 1220 of FIG. 12). It provides the highest resistance region possible underneath the structure where the signal is particularly sensitive to capacitive coupling effects. By dividing the large substrate into small uncoupled regions and inserting a high resistive element between different regions of the substrate, this method minimizes the unwanted coupling between non-adjacent resonators through the lossy silicon substrate and reduces induced unwanted eddy currents.

This discussion now turns to a 57-66 GHz 4th-order cross-coupled SIR-MH (Stepped-Impedance-Resonator-Meandering-Hairpin) microstrip bandpass filter with a pair of transmission zeros at finite frequencies. One of the biggest challenges that hinder designers from integrating millimeter-wave bandpass filters on CMOS processes is the high insertion loss and low selectivity that these integrated filters exhibit. There are three major issues that need to be considered.

1. Loss is induced in the substrate due to electrical coupling that deteriorates the quality factor of the resonators. This issue is addressed in the preceding example in relation to FIGS. 1 to 4.
2. Standard assumptions of thin film metal and thick dielectric substrate, used in the derivation of physical dimensions of single and coupled resonators in previous distributed filter design theories are not valid for on-chip filters as the physical thicknesses of on chip dielectrics and metal layers are not in the thin film regime. The silicon oxide layer between the signal layer and the ground plane is thin and the metal signal layer is thick. In this regime, edge and fringe capacitances are significant. In the thick metal slab the current distribution and the voltage potential (or E- and H-field distributions) over the top edge of the microstrip line cannot be treated as being the same as those on its bottom edge.
3. A CMOS die comprises of multiple dielectric and metal layers and thicknesses. Most conventional coplanar RF filter designs assume a single material substrate, where only a pure TEM (in stripline designs) or a Quasi-TEM (in microstrip designs) mode is propagated along the conductor. The multi-layer structure of CMOS die makes the determination of the electromagnetic field distribution of a transmission line or a filter design structure very difficult without 3D-EM simulation.

When high out-of-band signal rejection and low in-band signal transmission loss are required, the transfer function response having ripples on both passband and stopband gives the optimum solution to the filter design. This response can be realized by the cross-coupling topology providing a quasi-elliptic response. This cross-coupled bandpass filter has marginal increase in complexity when compared to the widely used Chebyshev response filter.

Figure 5:
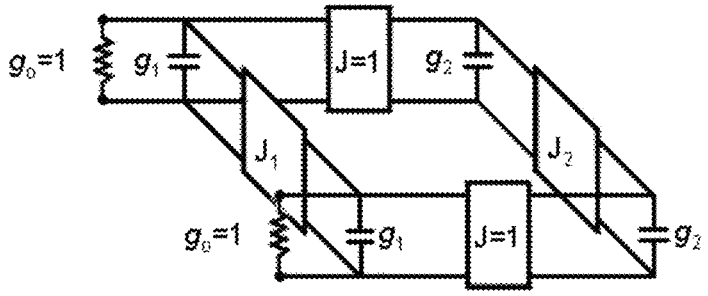
FIG. 5 is a circuit schematic of a lowpass fourth order quasi-elliptic filter.

The design in this example is a 4th-order cross-coupled bandpass filter. The lowpass prototype filter for the 4-order cross-coupled filter is indicated in FIG. 5. As can be seen between the filter's input and output there are two signal paths, namely $J_1$ and $J_2$. In our designs $J_1$ and $J_2$ are set to be out-of-phase, providing a pair of transmission zeros at finite frequencies.

Based on the design specification, the design's theoretical parameters are calculated using appropriate design equations. The next step is to design the physical structure of the filter which requires the choice of proper resonator types and the determination of the physical dimensions of resonators and the filter. In order to reach the best performance, it is critical to have the resonator designed with the highest quality factor (Q) as well as compact size. Since this filter was built on standard CMOS, some special considerations were made during the derivation of the resonator and the filter itself.

When the filter is built on standard CMOS, loss is induced in the lossy silicon substrate due to electrical coupling that deteriorates the quality factor of the resonators. In order to minimize the coupling between non-adjacent resonators and to reduce induced eddy currents, the substrate was segmented into regions of high impedance directly under each resonator. This is accomplished by implementing a high impedance shielding block beneath the normal metal ground plane between resonators. A high impedance bounding box is also built around the whole structure. The high impedance shielding block consists of a region underneath the structure that has the conductive P-well removed, leaving the bulk substrate material. This provides the highest resistance region possible underneath the structure where the signal is particularly sensitive to capacitive coupling effects. By dividing the large substrate into small uncoupled regions and inserting a high resistive element between different regions of the substrate, this method reduces the coupling through the substrate.

The theoretical parameters of the n-order bandpass filter can be transformed from those of its n-order lowpass prototype filter by $$Q_{e1} = Q_{e2} = \frac{g_1}{FBW} \tag{4}$$

$$M_{k,k+1} = M_{n-k,n-k+1} = \frac{FBW}{\sqrt{g_k g_{k+1}}} \text{ for } k = 1 \text{ to } m-1,$$

$$m = n/2$$

$$M_{m,m+1} = \frac{FBW \cdot J_m}{g_m}$$

$$M_{m-1,m+2} = \frac{FBW \cdot J_{m-1}}{g_{m-1}}$$

where $Q_{e1}$ and $Q_{e2}$ are the external quality factors of the input and output resonators, and $M_{k,k+1}$ are the coupling coefficients between adjacent resonators. $g_0, g_1, \ldots, g_{n+1}$ are the element parameters of the lowpass prototype filter, and FBW is the fractional bandwidth.

Having obtained the theoretical parameters of the design, the physical parameters can be identified by characterizing the coupling coefficient $M_{k,k+1}$ and the external quality factors $Q_{e1}$ and $Q_{e2}$ in terms of its physical dimensions. No matter what type of coupling between the pair of resonators, two resonant frequencies $f_{R1}$ and $f_{R2}$ in association with the mode splitting can be easily observed in a full-wave EM simulation. The coupling coefficient $M_{i,j}$ is related to the two resonant frequencies $f_{R1}$ and $f_{R2}$, and can be calculated by $$M_{i,j} = \frac{f_{R2}^2 - f_{R1}^2}{f_{R2}^2 + f_{R1}^2}. \tag{5}$$

The external quality factor is related to the coupling between the tapped feed line and the input/output resonator. When only the input/output resonator is placed in the full-wave EM simulator and excited through the tapped feed line, the external quality factor $Q_e$ can be calculated by $$Q_e = \frac{f_0}{BW_{3dB}} \tag{6}$$

where $f_0$ and $BW_{3dB}$ are the resonant frequency and the 3-dB bandwidth of the input/output resonator.

The 57-66 GHz 4th-order cross-coupled SIR-MH bandpass filter was designed using the above techniques. This filter has a passband from $f_1$=57 to $f_2$=66 GHz with the bandwidth BW=9 GHz. By optimizing the transfer function of the ideal normalized 4th-order quasi-elliptic response with a single pair of transmission zeros, a 4-order type filter with a pair of transmission zeros at a normalized frequency $\Omega=\pm\Omega_a=\pm1.80$ was implemented. The prototype element values of this filter are equal to:

$$g_1=0.95974, g_2=1.42192, J_1=-0.21083, J_2=1.11769. \tag{7}$$

The design parameters for this filter are equal to:

$$Q_{e1}=Q_{e2}=6.5422$$

$$M_{1,2}=M_{3,4}=0.1256$$

$$M_{2,3}=0.1153$$

$$M_{1,4}=-0.0322 \tag{8}$$

After the design's theoretical parameters are determined, the next step requires the choice of proper resonator types and the determination of the physical dimensions of resonators and the filter. Parameters of the physical dimension of single SIR (Step-Impedance-Resonator) miniaturized hairpin resonator, single MH (Meandering-Hairpin) resonator, and the SIR-MH bandpass filter are denoted in FIG. 6, FIG. 7, and FIG. 8 respectively.

In order to reach the best performance in the design, great efforts have been put on the choice of proper resonator types. In this design two different types of resonators were utilized. They are the SIR (Step-Impedance-Resonator) miniaturized hairpin resonator and the MH (Meandering-Hairpin) resonator. Parameters of the physical dimension of single SIR miniaturized hairpin resonator, single MH resonator, and the SIR-MH bandpass filter are denoted in FIG. 6, FIG. 7, and FIG. 8 respectively.

Figure 6:
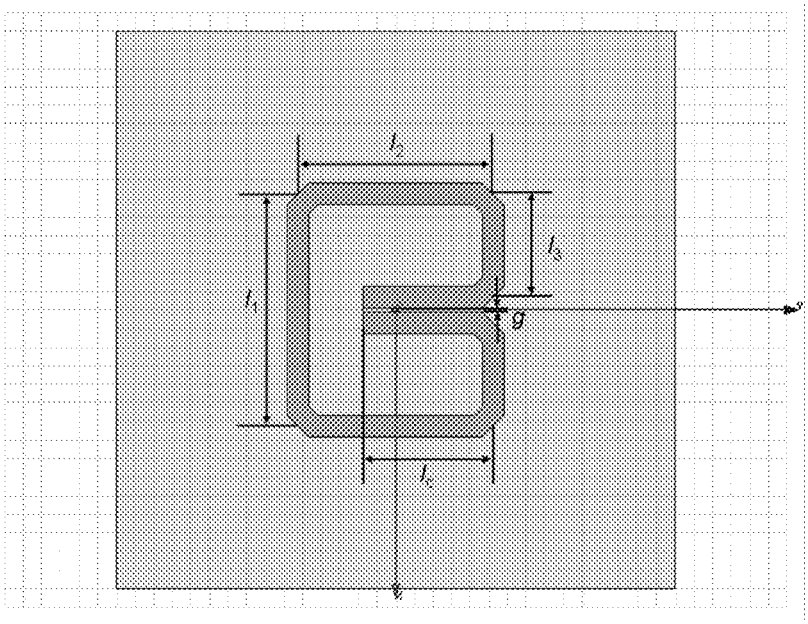
FIG. 6 illustrates the layout of a step impedance miniaturised hairpin resonator.

The resonator in FIG. 6 is a miniaturized hairpin with SIR configuration. Basically a SIR is a resonator alternatively cascading the high- and low-impedance transmission lines. In this design the SIR miniaturized hairpin resonator was chosen. The present embodiment recognises that by using SIR configuration the size of the resonator can be minimized. However due to the lossy nature of the silicon substrate in standard CMOS technology, low impedance values in coupled line sections may induce large capacitive coupling through the substrate. This will increase the loss. Therefore optimization of those physical dimension parameters is needed in order to reach the highest quality factor whilst keeping the size compact. With the aid of a 3D full-wave EM simulator, the physical dimensions of this SIR miniaturized hairpin resonator indicated in FIG. 6 can be determined as shown in Table III.

TABLE III

| Physical Dimensions of the SIR Miniaturized Hairpin Resonator |
|---|
| $w_t$ = 22.8 μm, $w_c$ = 22.8 μm, $l_1$ =250 μm, $l_2$ = 210 μm, $l_3$ = 111.1 μm, $l_c$ = 140 μm, g = 5 μm |

Figure 7:
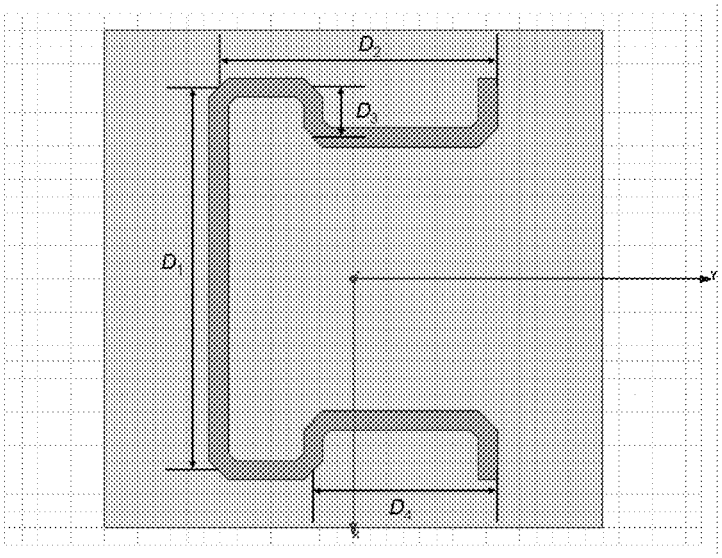
FIG. 7 illustrates the layout of a meandering hairpin resonator in accordance with a second embodiment of the third and fourth aspects of the invention.

Another type of resonator used in this design is the MH resonator, as indicated in FIG. 7. The MH resonator comprises a substantially straight primary strip portion corresponding to length $D_1$ and two secondary strip portions extending from respective ends of the primary strip portion and at substantially 90 degrees to the primary strip portion. Each secondary strip portion, for example corresponding to length $D_2$, comprises a resonating portion, for example corresponding to length $D_4$, for resonating with a proximal resonator. The two resonating portions are spaced apart by a distance less than a length of the primary strip portion. Each secondary strip portion comprises a dogleg bend, for example corresponding to length $D_3$, causing a distal portion of the secondary strip portion to be positioned closer to the other secondary strip portion such that an average spacing between the two secondary strip portions is less than a length of the primary strip portion. While derived from a conventional hairpin resonator, in order to make it compact a meandering configuration is used. Recognising that a meandering line may induce additional loss due to the effects of discontinuities at bends, chamfering or mitering of the conductor is used for loss compensation, and the number of bends is minimized. With the consideration of minimizing unwanted coupling between adjacent metal traces in a MH resonator as well as being able to provide sufficient coupling between adjacent resonators, the parameters of the physical dimensions need to be optimized. Based on 3D full-wave EM simulations the physical dimensions of this MH resonator indicated in FIG. 7 can be determined as set out in Table IV.

TABLE IV

| Physical Dimensions of the MH Resonator |
|---|
| w = 22.8 μm, $D_1$ = 461.2 μm, $D_2$ = 335.2 μm, $D_3$ = 60 μm, $D_4$ = 221.4 μm |

Figure 8:
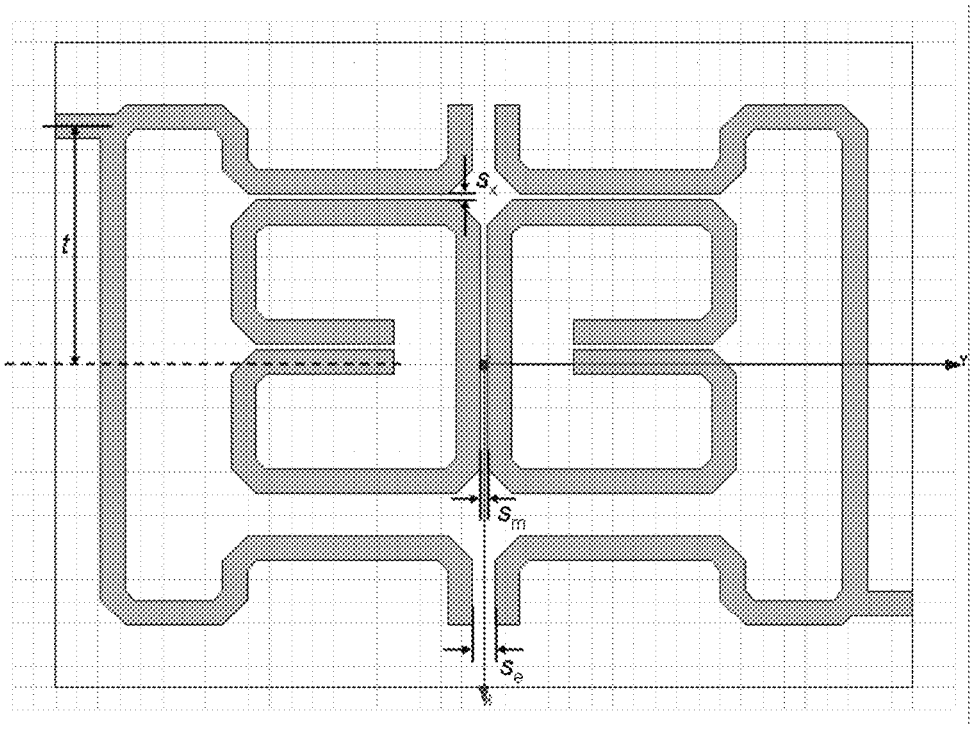
FIG. 8 illustrates the layout of a fourth order cross coupled bandpass filter formed from the resonators of FIGS. 6 and 7.

After the physical dimensions of a single resonator are obtained, the next step involves determination of the physical parameters of the filter as shown in FIG. 8, namely $s_e$, $s_m$, and $s_x$ for controlling coupling coefficients $M_{1,4}$, $M_{2,3}$, and $M_{1,2}/M_{3,4}$ respectively, and t for controlling external quality factor $Q_{e1}/Q_{e2}$. Using a 3D full-wave EM simulator, these physical parameters indicated in FIG. 8 for this 4th-order cross-coupled SIR-MH bandpass filter are determined. Fine tuning and process variation checks are then carried out for final refinements before the design is finalised as given in Table III.

TABLE III

| Physical Dimensions of the 4th-Order Cross-Coupled SIR-MH BPF |
|---|
| $s_e$ = 21.70 μm, $s_m$ = 5.57 μm, $s_x$ = 5.87 μm, t = 222 μm |

Figure 9:
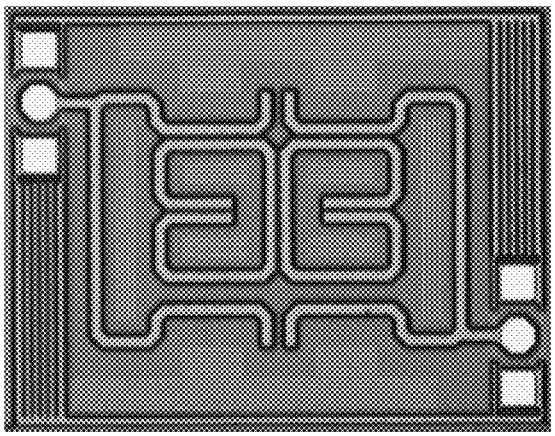
FIG. 9 is a microphotograph of the fabricated filter of the design shown in FIG. 8.
Figure 10:
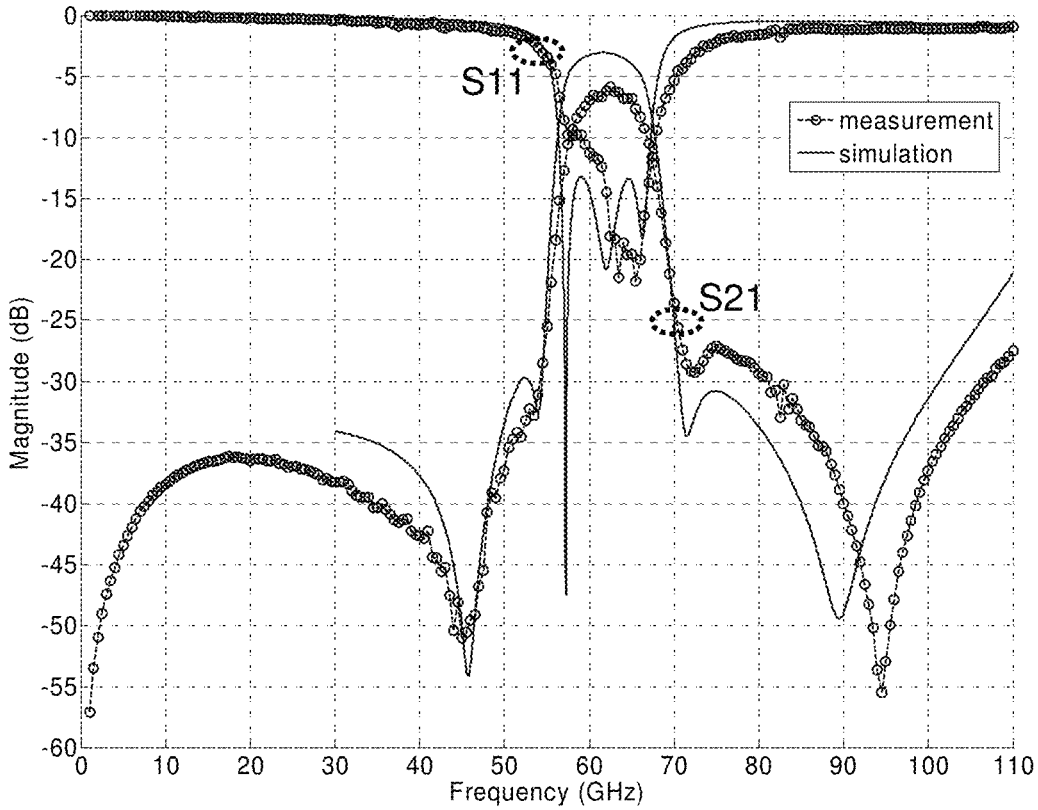
FIG. 10 illustrates measurement and simulation results of the filter of FIG. 9.
Figure 11:
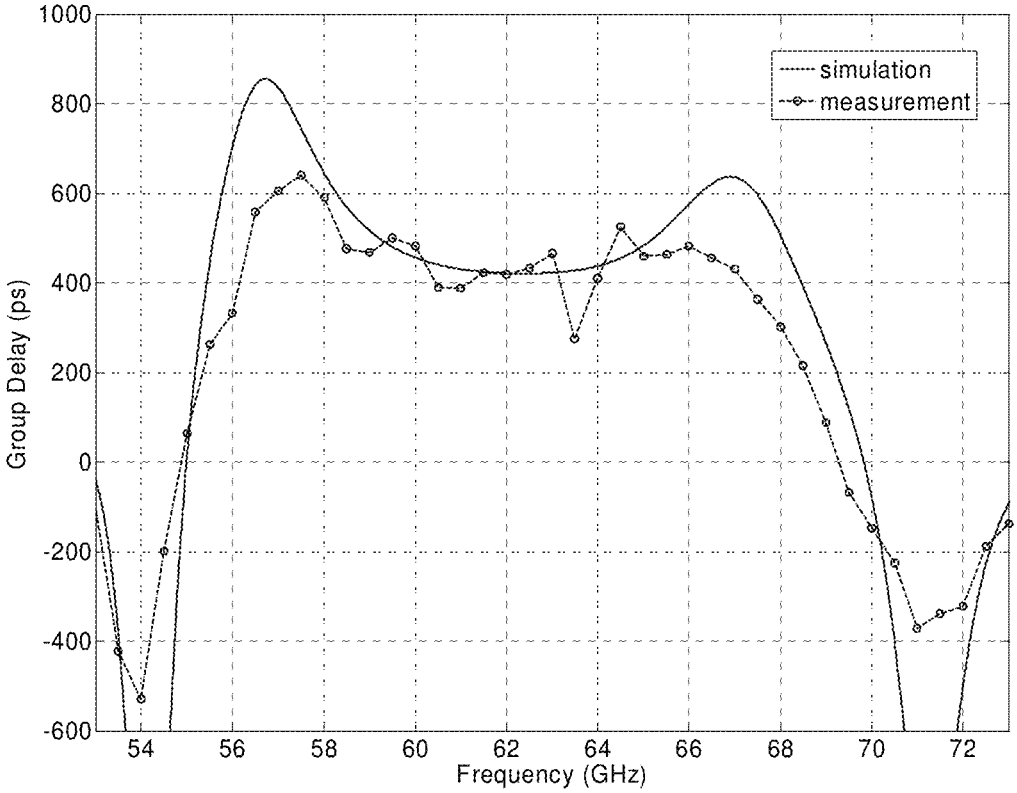
FIG. 11 illustrates the passband group delay of the filter simulation and the passband group delay measured from the fabricated filter of FIG. 9.

The above filter design was fabricated on the IBM 0.13 μm standard CMOS process and was built on the top aluminum metal layer (e.g., top layer 1210 of FIG. 12) with the ground plane (e.g., ground plane 1220 of FIG. 12) on the bottom copper metal layer. FIG. 9 shows the die graph of the filter design. The size of the filter is 714.9 μm×484 μm (0.346 $mm^2$). Measurement and simulation results are shown in FIG. 10. In FIG. 10 it is clearly seen that the filter has 8.5 GHz passband from 58 to 66.5 GHz, −5.9 dB insertion loss, and better than −10 dB return loss over the whole passband. Four transmission zeros had been introduced. Two of them that are closer to the passband are introduced by the cross-coupling topology, and are placed at 53.5 GHz and 72 GHz in the measurement. The other two zeros are introduced by a 0° Tapped Feed Structure, and are placed at about 45 GHz and around 94.5 GHz in the measurement. This designed filter achieves a steep rolling-off in the vicinity of the passband. The sidelobe in the lower stopband is better than −36 dB providing good out-of-band rejections at low frequencies. The passband group delays of both simulation and measurement of the filter design are shown in FIG. 11. In FIG. 11 it is noted that measured group delay is relatively flat and less than 650 ps over the whole passband. Simulation and measurement results match well. From the graphs in FIG. 11 it can be seen there is some noise in the measurement data.

Figure 13:
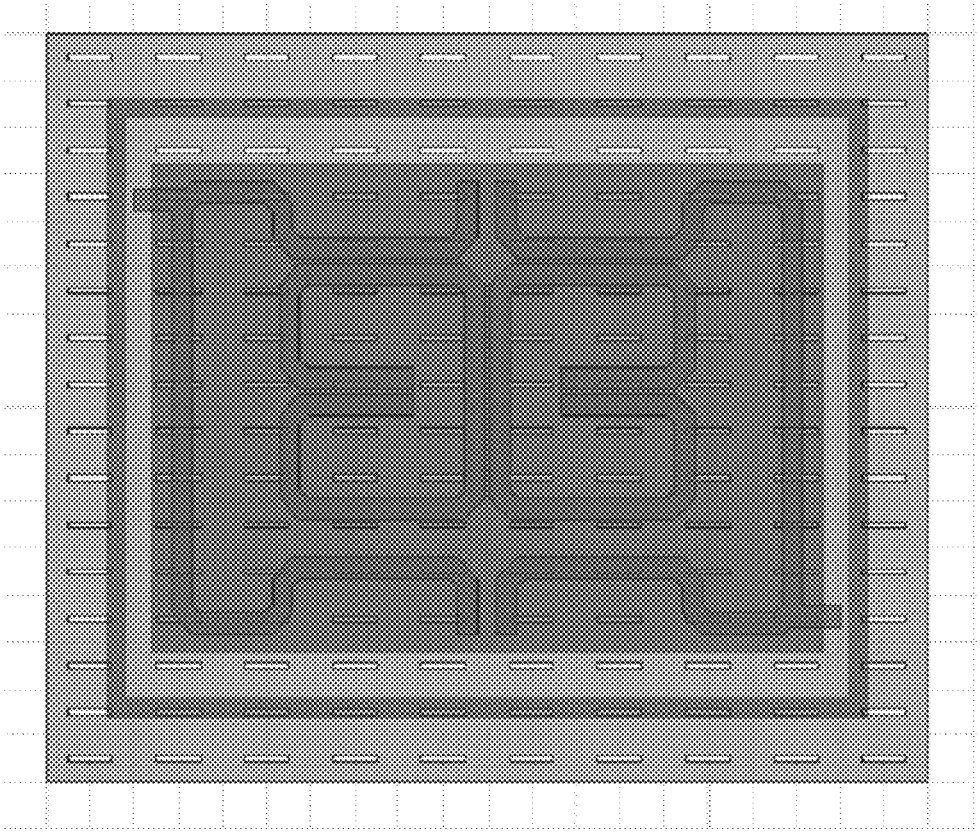
FIG. 13 is a ghosted top view of the design shown in FIG. 12.

FIG. 12 is a perspective view of the fabricated die as designed. The resonant filter components shown in FIGS. 8 and 9 are formed in a top layer 1210. A slotted ground plane 1220 is formed beneath the filter components 1210, and a high impedance shielding layer 1230 is formed beneath the ground plane 1220. The inner portion of high impedance shielding **1230*a* is designed to reduce filter coupling to the substrate and to reduce induced eddy currents. The outer ring of the high impedance shielding 1230*b* is designed to reduce the inter-component coupling through the substrate. FIG. 13 is a ghosted top view of the three discussed layers of the design shown in FIG. 12**.

The fabricated filter exhibits 1 GHz bandwidth shrink in the passband when compared to simulation. This is believed to be a result of process variations. There is also 2.8 dB more insertion loss at the mid-band frequency. This is attributed to the larger than predicted loss induced by the signal leakage to the Silicon substrate through the grid ground plane and the unwanted signal coupling between non-adjacent resonators through the silicon substrate.

This example thus provides for the design of a bandpass filter operating at 60 GHz on CMOS. Implementation of a 57-66 GHz 4th-order cross-coupled SIR-MH bandpass filter on 0.13 μm bulk CMOS is presented, demonstrating the applicability of the methods presented in building 60 GHz high-selectivity passive bandpass filters on CMOS. This filter is of higher order and has sharper selectivity whilst being of compact size. By applying the ground isolation technique, the loss due to the unwanted signal leakage to the silicon substrate through grid ground plane can be further diminished.

The resonator and the filter presented in this example can be used on different substrate materials or in different process technologies. The layout may have variations depending on the specific design, such as the coupling section in the SIR miniaturized hairpin resonator may become wider or longer, and the length of different sections in the MH resonator may vary. The method of implementing the high impedance shield block can also be used for other passive device designs on standard CMOS. The filter could be used in the design of the RF front-end in wireless transceivers or radars. This example also provides for a fully-integrated system on a die which greatly reduces the complexity and the cost of the design, and makes the system on chip or system in a package possible.

It will be appreciated by persons skilled in the art that numerous variations and/or modifications may be made to the invention as shown in the specific embodiments without departing from the scope of the invention as broadly described. The present embodiments are, therefore, to be considered in all respects as illustrative and not restrictive.

The invention claimed is:

1. A method of fabricating a monolithic millimeter wave resonant device upon a conductive substrate, the method comprising:

forming high impedance elements upon the conductive substrate; and forming resonant elements of the resonant device over the high impedance elements;

wherein the high impedance elements comprise a high impedance shielding layer directly beneath a slotted ground plane of the resonant elements;

wherein the high impedance shielding layer comprises an inner portion designed to reduce coupling of the resonant elements to the conductive substrate and to reduce induced eddy currents in the conductive substrate;

wherein the high impedance shielding layer comprises an outer ring designed to reduce coupling of the resonant elements through the conductive substrate with other resonant elements of the resonant device.

2. The method of claim 1 wherein the ground plane is fabricated on a bottom thin copper metal layer of a 0.13 um standard CMOS process, and wherein other portions of the resonant elements are formed on a top RF aluminum metal layer of the standard CMOS process.

3. The method of claim 1 wherein the resonant device comprises a RF filter.

4. The method of claim 1 wherein the conductive substrate is divided into uncoupled regions and a high resistive element is inserted between the uncoupled regions.

5. A monolithic millimeter wave resonant device, comprising:

a conductive substrate;

high impedance elements formed upon the conductive substrate; and resonant elements formed over the high impedance elements;

wherein the high impedance elements comprise a high impedance shielding layer directly beneath a slotted ground plane of the resonant elements;

wherein the high impedance shielding layer comprises an inner portion designed to reduce coupling of the resonant elements to the conductive substrate and to reduce induced eddy currents in the conductive substrate;

wherein the high impedance shielding layer comprises an outer ring designed to reduce coupling of the resonant elements through the conductive substrate with other resonant elements of the resonant device.

6. The resonant device of claim 5 wherein the ground plane is fabricated on a bottom thin copper metal layer of a 0.13 um standard CMOS process, and wherein other portions of the resonant elements are formed on a top RF aluminum metal layer of the standard CMOS process.

7. The resonant device of claim 5 wherein the resonant device comprises a RF filter.

8. The resonant device of claim 5 wherein the conductive substrate is divided into uncoupled regions and a high resistive element is inserted between the uncoupled regions.

9. A meandering hairpin resonator for a monolithic millimeter wave resonant device, the resonator formed of a longitudinal conducting strip comprising:

a substantially straight primary strip portion two secondary strip portions extending from respective ends of the primary strip portion and at substantially 90 degrees to the primary strip portion, each secondary strip portion comprising a resonating portion for resonating with a proximal resonator, the two resonating portions being spaced apart by a distance less than a length of the primary strip portion;

wherein each secondary strip portion comprises a dogleg bend causing a longitudinal outer edge and a longitudinal inner edge of a distal portion of the secondary strip portion to be positioned closer to the other secondary strip portion such that an average spacing between the longitudinal outer edges of the two distal portions is less than the length of the primary strip portion and an average spacing between the longitudinal inner edges of the two distal portions is less than the length of the primary strip portion;

wherein a spacing between the longitudinal inner edges of the distal portions of the two secondary strip portions is sufficient to accommodate substantially all of a step impedance miniature hairpin resonator between the longitudinal inner edges of the distal portions of the two secondary strip portions.

10. The meandering hairpin resonator of claim 9 wherein corners formed by the conducting strip are mitered and chamfered to minimize losses.

11. A 4th order cross coupled filter comprising:

a first meandering hairpin resonator in accordance with claim 9;

a second meandering hairpin resonator in accordance with claim 9;

a first step impedance miniature hairpin resonator;

a second step impedance miniature hairpin resonator;

wherein substantially all of the first step impedance miniature hairpin resonator is positioned in the spacing between the longitudinal inner edges of the distal portions of the two secondary strip portions of the first meandering hairpin resonator; and wherein substantially all of the second step impedance miniature hairpin resonator is positioned in the spacing between the longitudinal inner edges of the distal portions of the two secondary strip portions of the second meandering hairpin resonator.

12. The meandering hairpin resonator of claim 9 wherein:

the length of the primary strip portion is substantially 461.2 μm, a length of each secondary strip portion is substantially 335.2 μm, the spacing between the distal portions of the two secondary strip portions is substantially 341.2 μm, and a length of the distal portion of each secondary strip portion is substantially 221.4 μm.

13. A method of fabricating a meandering hairpin resonator formed of a longitudinal conducting strip, the method comprising:

forming a substantially straight primary strip portion; and forming two secondary strip portions extending from respective ends of the primary strip portion and at substantially 90 degrees to the primary strip portion, each secondary strip portion comprising a resonating portion for resonating with a proximal resonator, the two resonating portions being spaced apart by a distance less than a length of the primary strip portion;

wherein each secondary strip portion comprises a dogleg bend causing a longitudinal outer edge and a longitudinal inner edge of a distal portion of the secondary strip portion to be positioned closer to the other secondary strip portion such that an average spacing between the longitudinal outer edges of the two distal portions is less than the length of the primary strip portion and an average spacing between the longitudinal inner edges of the two distal portions is less than the length of the primary strip portion;

wherein a spacing between the longitudinal inner edges of the distal portions of the two secondary strip portions is sufficient to accommodate substantially all of a step impedance miniature hairpin resonator between the longitudinal inner edges of the distal portions of the two secondary strip portions.

14. The method of claim 13 wherein:

the length of the primary strip portion is substantially 461.2 μm, a length of each secondary strip portion is substantially 335.2 μm, the spacing between the distal portions of the two secondary strip portions is substantially 341.2 μm, and a length of the distal portion of each secondary strip portion is substantially 221.4 μm.

15. A 4th order cross coupled filter comprising:

a first meandering hairpin resonator fabricated in accordance with the method of claim 13;

a second meandering hairpin resonator fabricated in accordance with the method of claim 13;

a first step impedance miniature hairpin resonator;

a second step impedance miniature hairpin resonator;

wherein substantially all of the first step impedance miniature hairpin resonator is positioned in the spacing between the longitudinal inner edges of the distal portions of the two secondary strip portions of the first meandering hairpin resonator; and wherein substantially all of the second step impedance miniature hairpin resonator is positioned in the spacing between the longitudinal inner edges of the distal portions of the two secondary strip portions of the second meandering hairpin resonator.

* * * * *